US006341999B1

(12) United States Patent
Ohmori et al.

(10) Patent No.: US 6,341,999 B1
(45) Date of Patent: Jan. 29, 2002

(54) GLASS SUBSTRATE CHAMFERING METHOD AND APPARATUS

(75) Inventors: Hitoshi Ohmori, Wako; Muneaki Asami, Tokyo; Akihiko Uzawa, Kanagawa; Sadamasa Shigitani, Hukuyama, all of (JP)

(73) Assignees: Riken, Wako; Utksystem Corporation, Sagamihara; The Nexsys Corporation, Tokyo, all of (JP)

( * ) Notice: Subject to any disclaimer, the term of this patent is extended or adjusted under 35 U.S.C. 154(b) by 0 days.

(21) Appl. No.: 09/669,684

(22) Filed: Sep. 26, 2000

(30) Foreign Application Priority Data

Sep. 30, 1999 (JP) ..... 11-278976

(51) Int. Cl.[7] ..... B24B 1/00

(52) U.S. Cl. ..... 451/44; 451/51; 451/56; 451/61; 451/443; 451/210

(58) Field of Search ..... 451/41, 44, 51, 451/52, 56, 443, 61, 194, 209, 210, 257, 72

(56) References Cited

U.S. PATENT DOCUMENTS 4,254,588 A * 3/1981 Onoda et al.
4,386,483 A * 6/1983 Schlaefli
4,843,766 A * 7/1989 Umeda
5,833,520 A * 11/1998 Kanda et al. ..... 451/72
6,149,504 A * 11/2000 Ohmori et al. ..... 451/56
6,162,348 A * 12/2000 Ohmori ..... 205/663
6,244,939 B1 * 6/2001 Ohmori et al. ..... 451/72

FOREIGN PATENT DOCUMENTS

JP 04115867 A 4/1992

* cited by examiner

*Primary Examiner*—Eileen P. Morgan
(74) *Attorney, Agent, or Firm*—Griffin & Szipl, P.C.

(57) ABSTRACT

A method for glass substrate chamfering using a metal-bonded outer-surface grindstone 12 for simultaneously processing the end surface and the oblique surfaces of the outer periphery of a doughnut-like glass substrate 1 with a circular hole 1*a* at the center thereof, and a metal-bonded inner-surface grindstone 14 for simultaneously processing the end surface and the oblique surfaces of the inner periphery are provided; the outer-surface grindstone and the inner-surface grindstone simultaneously grind end surfaces and oblique surfaces of the outer and inner peripheries of the glass substrate, and during grinding, the outer-surface grindstone is sharpened by dressing it electrolytically, and the inner-surface grindstone is sharpened by an electrolytic dressing when not processing as the glass substrate is being replaced. Thus, edge portions of the glass substrate for a hard disk can be processed accurately, efficiently, and with high quality, and the need for a subsequent process, such as buff-polishing, is reduced or even eliminated.

14 Claims, 4 Drawing Sheets

GLASS SUBSTRATE CHAMFERING METHOD AND APPARATUS

BACKGROUND OF THE INVENTION

1. Technical Field of the Invention

The present invention relates to a chamfering method and apparatus for processing the edges of a glass substrate for a hard disk.

2. Prior Art

A hard disk is a storage device of a computer; the surface of a thin doughnut-like circular disk is coated with a magnetic substance in which data are stored. Aluminum has been used conventionally as the material of this circular disk (hereafter referred to as "hard disk substrate"). However, recently, chemically reinforced glass or crystalline glass have been used as the substrate of a hard disk (referred to as "glass substrate").

FIGS. 1A and 1B schematically show a glass substrate; FIG. 1A is a general view, and FIG. 1B shows a sectional view of the outer and inner peripheries. For a glass substrate with a nominal size of 2.5 inches, for example, outer and inner diameters are 2.5 and 1 inches (about 63 mm and about 25 mm), respectively, and the thickness is about 1.6 mm. The outer and inner peripheries (also referred to as "edge portions") are composed of end surfaces (with a width of 0.6 mm) at outer and inner peripheries, and a pair of oblique surfaces sandwiching the peripheries (with an angle of about 45°).

The aforementioned glass substrate is subjected to high-speed revolutions of several tens thousand revolution per minutes to shorten the access time of the hard disk. Consequently, the entire body thereof must be processed precisely, and a high dynamic balance must be achieved. Both surfaces of the glass substrate are finished to a mirror surface of an Rz of 1 $\mu$m or less, so that a magnetic substance can be coated at a high density to maximize memory capacity.

In addition, edges (including end surfaces and oblique surfaces) should be finished to mirror surface quality with such high accuracy and quality as required by both surfaces of the glass substrate. The reason edge portions are finished to mirror surface quality is explained below.

(1) There are microscopic cracks on a rough pear-like surface. As a result, a glass reinforcing treatment may result in unevenness, or cracks may grow due to high-speed revolutions during operation, eventually causing breakage of the substrate.

(2) Contaminants may remain in microscopic recesses of a crack, so cleaning may be incomplete, and it may be a source of contamination in a subsequent process.

Edge portions of the above-mentioned glass substrate were, in the prior art, finished to mirror surface quality first by using a formed plated grindstone,which is highly precise, and then by buffing to mirror surface quality.

However, compared to an aluminum substrate, a glass substrate provides poor machinability, so one problem was that machining efficiency, when using a plated grindstone, was low. More explicitly, although rather coarse grinding particles of #500 (grain diameter of about 30 $\mu$m) to #600 (grain diameter of about 25 $\mu$m) are used, grinding particles still peel considerably; therefore, the plated grindstone must be replaced frequently, so the continuous processing period with the machine is short and operating ratio is low because the grindstone must be replaced. In addition, since the processed surface is in a pear-like state with a rough surface, buff-polishing must be carried out for a long time (about one hour) as a subsequent process to the machining with the plated grindstone. Consequently, overall productivity is low, which is a practical problem.

SUMMARY OF THE INVENTION

The present invention aims to solve these problems. That is, an object of the present invention is to provide a chamfering method and apparatus for the glass substrate of a hard disk, with which edge portions of the substrate can be processed with high accuracy, quality, and efficiency, thereby greatly reducing the need for a subsequent process, such as buff-polishing, or even eliminating it. The present invention provides, as a method of processing end surfaces of outer and inner peripheries of a doughnut-like glass substrate (1) with a circular hole (1*a*) at the center thereof and chamfering oblique surfaces sandwiching the end surfaces, a glass substrate chamfering method using a metal-bonded outer-surface grindstone (12) for simultaneously processing the end surface and oblique surfaces of the outer periphery, and a metal-bonded inner-surface grindstone (14) for simultaneously processing the end surface and oblique surfaces of the inner periphery, wherein by means of the outer-surface grindstone and the inner-surface grindstone, end surfaces and oblique surfaces of outer and inner peripheries of the glass substrate are ground at the same time, and during a grinding process, the outer-surface grindstone is dressed electrolytically to sharpen the grinding particles, and during a non-processing period to replace the glass substrate, the inner-surface grindstone is dressed electrolytically.

The present invention also provides a chamfering apparatus for processing end surfaces of inner and outer peripheries of the doughnut-like glass substrate (1) having a circular hole (1*a*) at the center thereof and chamfering oblique surfaces sandwiching the end surfaces, composed of the metal-bonded outer-surface grindstone (12) for processing the end surface and oblique surfaces of the outer periphery, the metal-bonded inner-surface grindstone (14) for simultaneously processing the end surface and oblique surfaces of the inner periphery, the outer-surface electrode (18) for electrolytically dressing the outer-surface grindstone during the grinding process, the inner-surface electrode (20) for electrolytically dressing the inner-surface grindstone during the non-processing period, a grinding liquid feeder (22) for supplying a conductive grinding liquid between the outer-surface grindstone and the outer-surface electrode and between the inner-surface grindstone and the inner-surface electrode, and a voltage application means (24) for applying an electrolytically dressing voltage across the outer-surface grindstone and the outer-surface electrode and across the inner-surface grindstone and the inner-surface electrode, wherein the outer-surface grindstone is dressed electrolytically when the outer-surface grindstone is grinding the end surface and oblique surfaces of the outer periphery of the glass substrate, and during a non-processing period when the glass substrate is being replaced, the inner-surface grindstone is dressed electrolytically.

According to the method and the apparatus of the present invention, as described above, end surfaces and oblique surfaces of outer and inner peripheries of the glass substrate (1) can be ground simultaneously using the outer-surface grindstone (12) and the inner-surface grindstone (14). In addition, during this grinding period, the outer-surface grindstone is dressed electrolytically (also known as "in-process dressing") using the voltage application means (24) while supplying a conductive grinding liquid between the grindstone and the outer-surface surface electrode (18), thereby even when fine grinding particles are used, the outer-surface grindstone can be sharpened, therefore, while maintaining a high efficiency, the workpiece can be processed with a high accuracy and quality. Furthermore, the conductive grinding liquid is supplied between the inner-surface grindstone and the inner-surface electrode (20) when the glass substrate is replaced during a non-work period, the grindstone is dressed electrolytically (also known as "interval dressing") by the same voltage application means. Therefore, even when similar fine grinding particles are used, the inner-surface grindstone can be sharpened while maintaining high efficiency and can process a workpiece precisely with high quality.

In addition, because the outer-surface grindstone undergoes in-process dressing during grinding, and the inner-surface grindstone undergoes interval dressing during a non-processing period, the load of the voltage application means (24) can be averaged, and compared to an alternate method where both grindstones are dressed at the same time, the power supply facility can be made more compact.

According to a preferred embodiment of the present invention, an electrode (16) for discharge truing is installed in place of the above-mentioned glass substrate (1), the aforementioned outer-surface grindstone (12) and inner-surface grindstone (14) are positioned at a grinding position, the aforementioned electrode (16) and grindstones (12, 14) are charged positive and negative, respectively, and both grindstones are formed by discharge truing.

Using the above method, even if the outer-surface grindstone (12) or inner-surface grindstone (14) deteriorates in terms of shape accuracy after long-term use, an error in the installation of the grindstones caused by removing and remounting the grindstones can be avoided. In addition, the workpiece can be formed with a high accuracy because the grindstones can be subjected to truing by discharge while being mounted. Moreover, the power supply for electrolytic dressing (also referred to as the "voltage application means") can be used for discharge truing simply by changing polarity, so the power supply need not have a large supply capacity.

Also, the above-mentioned metal-bonded outer-surface grindstone (12) and metal-bonded inner-surface grindstone (14) have circular cylindrical outer surfaces and frustum-type grooves **(12*a*, 14*a*)** that can contact end surfaces and oblique surfaces of the circular cylindrical surfaces.

In this configuration, edge portions of the glass substrate can be processed precisely with high quality simply by making frustum-type grooves **(12*a*, 14*a*) of the formed grindstones come into contact with edge portions (also referred to as the "outer periphery" and "inner periphery") of the glass substrate (1)**.

The aforementioned metal-bonded outer-surface grindstone (12) and/or metal-bonded inner-surface grindstone (14) are provided with a plurality of frustum-type grooves **(12*a*, 14*a*)** with separating intervals around the same axis. With this configuration, if the accuracy of the shape of a groove deviates from the specified value due to wear caused by processing, the grindstone can be shifted axially and the grooves can be used sequentially, thereby the process can be carried out without a stopping, and continuous operation can be greatly extended.

In addition, the above-mentioned metal-bonded outer-surface grindstone (12) and/or metal-bonded inner-surface grindstone (14) are provided with frustum-type grooves **(12*a*, 14*a*)** for rough processing and finish processing, with intervals around the same axis.

Due to this configuration wherein the grindstones are provided with frustum-type grooves for rough processing and finish processing respectively, after the workpiece is processed roughly by rough-processing frustum-type grooves **(12*a*, 14*a*), the grindstone is shifted in the axial direction, and finish processing frustum-type grooves (12*a*, 14*a*)** on the same grindstone can be used for finish processing. Therefore, compared to the prior art method in which the worn grindstone is replaced with another fresh grindstone, down-time can be greatly reduced, while avoiding the deterioration of processing accuracy caused by decentering (also known as "axial deviation") of the center of rotation.

Moreover, another preferred embodiment of the present invention is provided with a substrate drive device (32) that drives the glass substrate (1) to rotate around the axial center thereof, an outer-surface grindstone drive device (34) that drives the metal-bonded outer-surface grindstone (12) around the axial center thereof, and an inner-surface grindstone drive device (36) that drives the metal-bonded inner-surface grindstone (14) around the axial center thereof; the substrate drive device, outer-surface grindstone drive device and/or inner-surface grindstone drive device are configured to be movable between the processing position of the glass substrate and a non-processing position where the outer-surface grindstone and the inner-surface grindstone are kept away from the glass substrate while the glass substrate is replaced.

In this configuration, when the metal-bonded outer-surface grindstone (12) and the metal-bonded inner-surface grindstone (14) are positioned at the processing location, the outer-surface grindstone is dressed electrolytically (the process of in-process dressing), while grinding the workpiece, and when both grindstones are positioned at a non-processing location, the glass substrate can be replaced while the inner-surface grindstone is being dressed electrolytically (the process of interval dressing).

The aforementioned substrate drive device (32) is provided with a vacuum suction head **(33*a*) to suck the glass substrate (1) and a supporting head (33*b*) that supports the glass substrate between the vacuum suction head. This configuration allows the vulnerable glass substrate (1) to be driven and rotated precisely, while being protected when it is sandwiched by the vacuum suction head (33*a*) and the supporting head (33*b*)**.

In another configuration, a detachable discharge truing electrode (16) is sandwiched between the aforementioned vacuum suction head **(33*a*) and the supporting head (33*b*), and electrode (16) being provided with an outer periphery and inner periphery that match the glass substrate (1). In this configuration, even if the outer-surface grindstone (12) or the inner-surface grindstone (14) deteriorates in terms of shape accuracy after a long-term operation, the grindstone can continue high-accuracy forming by being discharge trued, without the need to remove the grindstone and remount it to the machine, simply by setting the discharge truing electrode (16) in place of the glass substrate (1)**.

Other objects and advantages of the present invention are revealed according to the following description referring to the attached drawings.

DESCRIPTION OF PREFERRED EMBODIMENTS

Figure 1A:
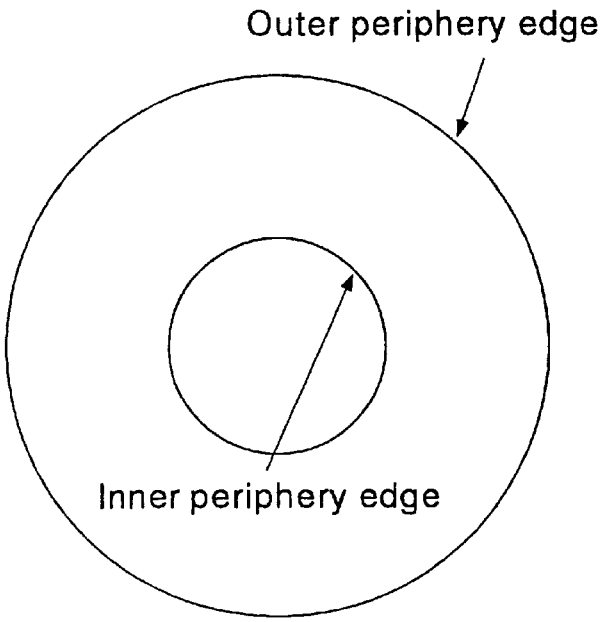
Fig.1A (Prior Art)
FIGS. 1A and 1B are schematic views of a glass substrate.

Preferred embodiments of the present invention are described below referring to the drawings. The same components in each drawing are identified with the same numbers, and no duplicate description is given.

The electrolytic in-process dressing (ELID) grinding method developed as a means of grinding an ultra-precise mirror surface with high efficiency, which was considered impossible using conventional grinding technologies, is disclosed. According to this ELID grinding method, conductive joined parts of a metal-bonded grindstone are dissolved by electrolytic dressing to sharpen the grindstone while it is grinding. According to this grinding method, even a cemented carbide material can be efficiently processed to a mirror surface using a metal-bonded grindstone with fine grinding particles: therefore, the efficiency and the precision of processing can be improved.

Figure 2:
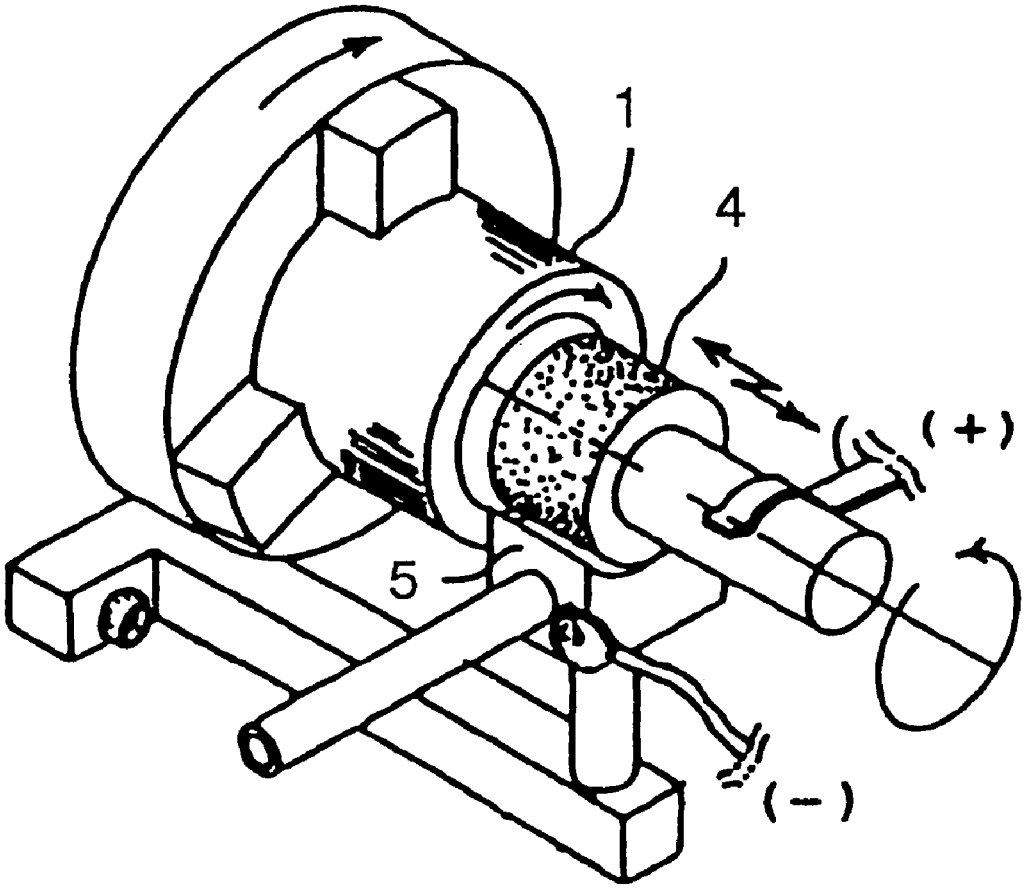
Fig.2 (Prior Art)
FIG. 2 is an isometric view of a conventional electrolytic interval-dressing grinding device used in the prior art method.

The inventors of the present invention have applied for a Japanese patent, "Electrolytic Interval Dressing Method for Grinding" (unexamined Japanese patent application No. 115867/1992). A sketch of this prior art device and method is shown in FIG. 2; an electrode 5 is provided with a gap in which workpiece 1 is ground, a conductive grindstone 4 with a voltage is driven and reciprocated between the workpiece 1 and the electrode 5, a conductive grinding liquid is interposed between the conductive grindstone 4 and the electrode 5, and electrolytic dressing and grinding is carried out alternately.

The present invention combines the aforementioned in-process dressing (ELID method) and interval dressing, and adds various novel devices for chamfering a glass substrate.

Figure 1B:
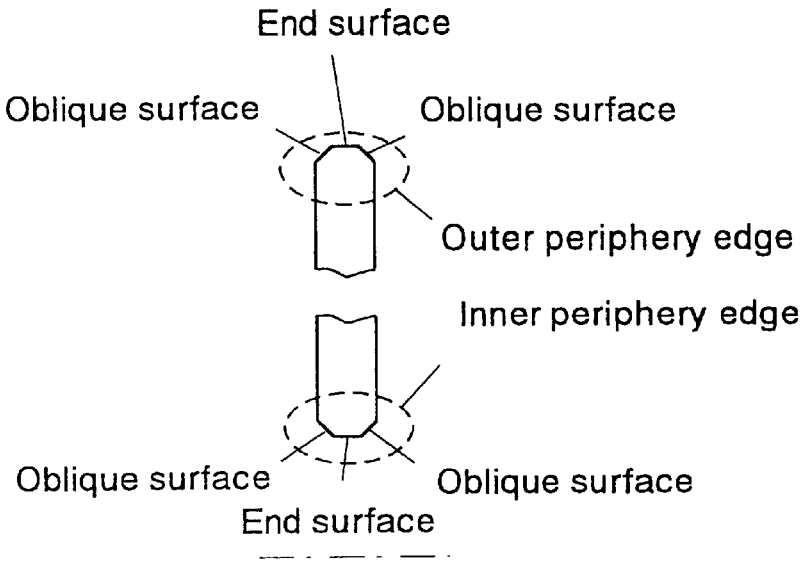
Fig.1B (Prior Art)

The chamfering apparatus according to the present invention is used to process end surfaces of outer and inner peripheries of a doughnut-like glass substrate 1, as shown in FIGS. 1A and 1B, with a circular hole 1*a* at the center thereof, and processing and chamfering edges of oblique surfaces flanked on the end surfaces.

Figure 3:
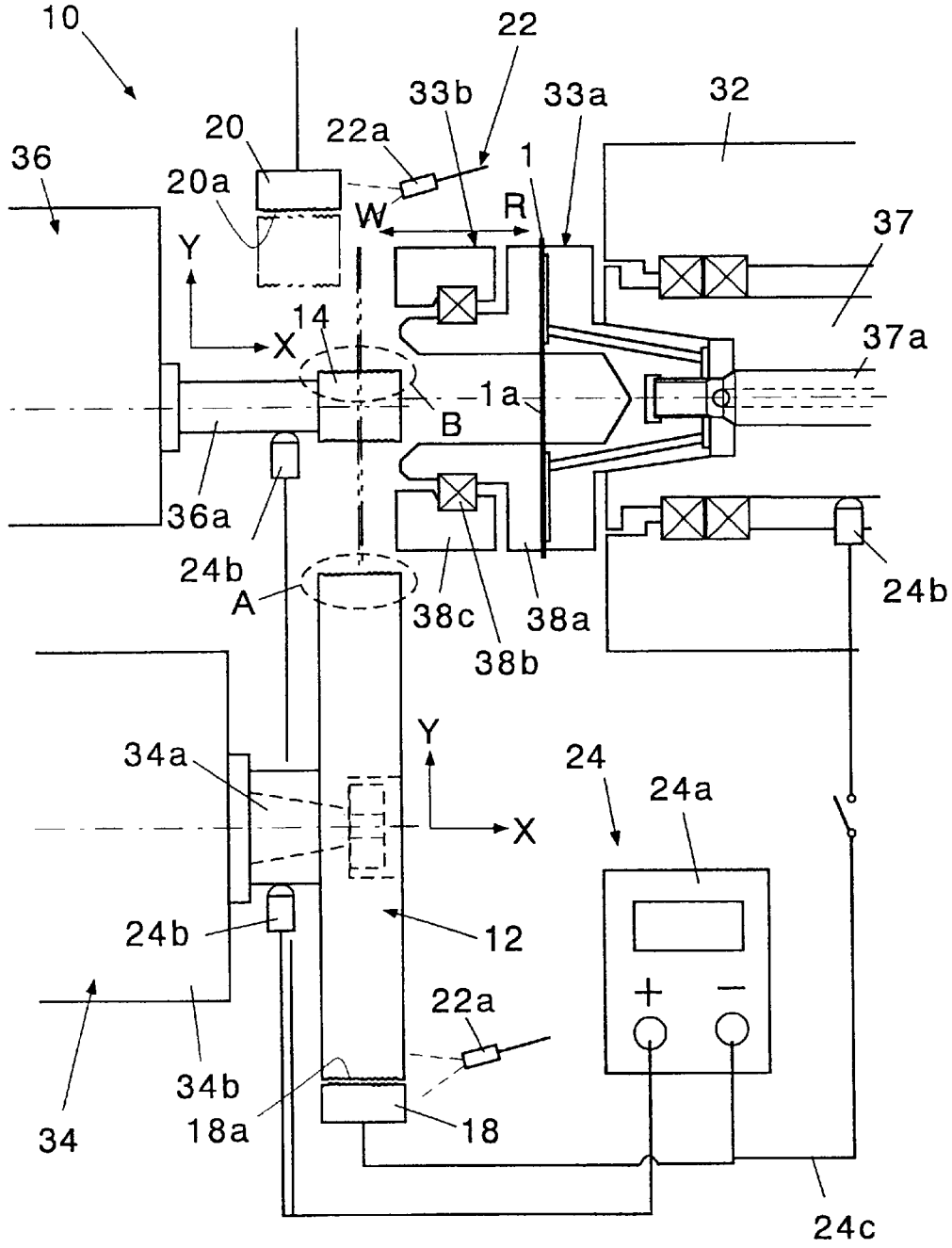
FIG. 3 is a plan view showing the general configuration of the chamfering apparatus used in the method according to the present invention.

In FIG. 3, this chamfering apparatus 10 is provided with a metal-bonded outer-surface grindstone 12, a metal-bonded inner-surface grindstone 14, an outer-surface electrode 18, an inner-surface electrode 20, a grinding liquid feeder 22, and a voltage application means 24.

The metal-bonded outer-surface grindstone 12 and the metal-bonded inner-surface grindstone 14 are composed of grinding particles (for instance, diamond or CBN) and a conductive joining part (referred to as the "metal-bonded part") that fixes the grinding particles. The metal-bonded part is a metal such as cast steel or bronze, molten and solidified.

Figure 4:
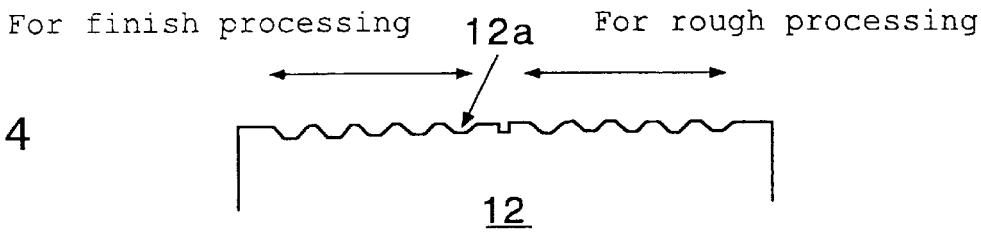
FIG. 4 is an enlarged view of A part in FIG. 3.
Figure 5:
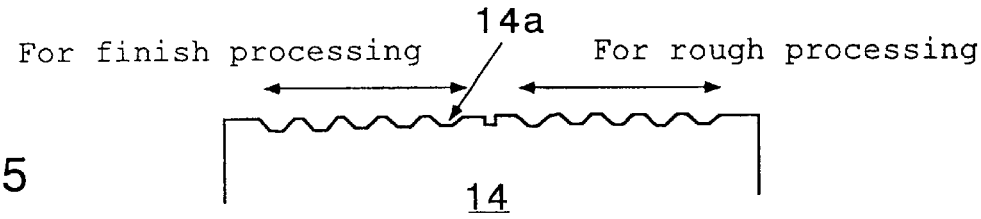
FIG. 5 is an enlarged view of B part in FIG. 3.

As shown in FIGS. 3 to 5, the outer peripheries of metal-bonded outer-surface grindstone 12 and metal-bonded inner-surface grindstone 14 are circular and cylindrical, and are provided with frustum-like grooves 12*a* and 14*a* respectively that can contact the end surface and oblique surfaces on the cylindrical surface. These frustum-like grooves 12*a*, 14*a* are formed for processing edges of the glass substrate 1 with great precision and high quality simply by having the grooves contact the edge portions (outer periphery and inner periphery) of the glass substrate during grinding.

As shown in FIGS. 4 and 5, a plurality of frustum-like grooves 12*a*, 14*a* are provided (for example, ten grooves each) on the same axis of the metal-bonded outer-surface grindstone 12 and the metal-bonded inner-surface grindstone 14 respectively at predetermined intervals. In this example, among the ten grooves, one half of the frustum-like grooves 12*a*, 14*a* are formed for performing a rough processing, and the remainder for performing a finish processing.

In this configuration, the metal-bonded outer-surface grindstone 12 can simultaneously process the end surface and oblique surfaces of the outer periphery of glass substrate 1, and the metal-bonded inner-surface grindstone 14 can also simultaneously process the end surface and oblique surfaces of the inner periphery of the substrate 1.

In FIG. 3, the chamfering apparatus 10 according to the present invention is further provided with substrate drive device 32, outer-surface grindstone drive device 34, and inner-surface grindstone drive device 36.

The substrate drive device 32 is composed of a vacuum suction head 33*a* for sucking the glass substrate 1, and a supporting head 33*b* for pinching and supporting the glass substrate 1 to the vacuum suction head 33*a*. The detachable vacuum suction head 33*a* is mounted to a drive axis 37, which is driven and rotated around the axial center of the glass substrate 1, by screwing threads of a connecting rod 37*a*. In addition, the end surface (left side in this figure) of the vacuum suction head 33*a* can vertically suck and hold the glass substrate 1 by evacuating a space at the contact surface of the glass substrate 1 via an exhaust passage provided in the vacuum suction head 33*a*.

The supporting head 33*b* is composed of a pinching head 38*a* contacting the opposite side (left side in this figure) of the glass substrate 1 and a supporting part 38*c* for supporting the substrate via a bearing 38*b*.

The substrate drive device 32 is configured to be capable of traveling in the left and right direction (X direction) between position W for processing the glass substrate 1 and non-processing position R (state of FIG. 3), where the outer-surface grindstone 12 and the inner-surface grindstone 14 are removed from the glass substrate 1 and the substrate can be replaced.

The above-mentioned supporting part 38*c* is powered at position W for processing the glass substrate 1, by a powering device not illustrated at a predetermined pressure to the right in the figure, thereby it pinches and holds the glass substrate 1 at the vacuum suction head 33*a* with a satisfactory pressure.

Due to this configuration, the glass substrate 1 can be driven and rotated by the substrate drive device 32 around the axial center thereof, while resisting a processing load during grinding of the outer and inner peripheries of the glass substrate 1.

The outer-surface grindstone drive device 34 is provided with a drive shaft 34*a* that fixes the metal-bonded outer-surface grindstone 12 to the right end in the figure. This drive shaft 34*a* is parallel to the axial center of the glass substrate 1, and is driven and rotated by a drive device not illustrated. In addition, this outer-surface grindstone drive device 34 is arranged to be capable of freely traveling in backward and forward directions (Y direction) perpendicular to left and right directions (X direction) in the figure, by an NC control system. In this configuration, a predetermined frustum-like groove 12*a* for processing the glass substrate 1 is positioned corresponding to the glass substrate 1 located at a processing position W by moving the outer-surface grindstone 12 in the X direction from the non-processing position R shown in FIG. 3, and the outer-surface grindstone 12 is moved in the Y direction so that it contacts the outer periphery of the glass substrate 1 and the edge portion can be processed.

The inner-surface grindstone drive device 36 is also provided with a drive shaft 36*a* that fixes the metal-bonded inner-surface grindstone 14 to the right end in the figure, in the same way as with outer-surface grindstone drive device 34. This drive shaft 36*a* is parallel to the axis of the glass substrate 1, and is driven and rotated by a drive device, which is not illustrated. In addition, this inner-surface grindstone drive device 36 is also capable of freely traveling in backward and forward directions (Y direction) perpendicular to left and right directions (X direction) in the figure by the NC control system. In this configuration, a predetermined frustum-like groove 12*a* that processes the glass substrate 1 by moving the inner surface grindstone 14 in the X direction is positioned according to the glass substrate 1, and further the inner-surface grindstone 12 is moved in the Y direction so that it contacts the inner periphery of the glass substrate 1 and can process the edge portion.

The outer-surface electrode 18 is mounted in the main body 34*b* of the outer-surface grindstone drive device 34 via an insulation member (not illustrated), and can travel together with the outer-surface grindstone drive device 34. This outer-surface electrode 18 is also provided with an opposite surface 18*a* at a predetermined spacing from a plurality of frustum-like grooves 12*a* of the metal bond outer-surface grindstone 12.

The inner-surface electrode 20 can travel in backward and forward directions (Y direction) from the non-processing position R shown in FIG. 3 to a position close to the metal-bonded inner-surface grindstone 14. This inner-surface electrode 20 is also provided with an opposing surface 20*a* with a predetermined spacing from a plurality of frustum-like grooves 14*a* of the metal-bonded inner-surface grindstone 14.

The grinding liquid feeder 22 supplies a conductive grinding liquid between the outer-surface grindstone 12 and the outer-surface electrode 18 and between the inner-surface grindstone 14 and the inner-surface electrode 20. More explicitly, the grinding liquid feeder 22 is provided with a nozzle 22*a* fixed to the main body 34*b* of the outer-surface grindstone drive device 34, and can supply the conductive grinding liquid between the outer-surface grindstone 12 and the outer-surface electrode 18, irrespective of where the outer-surface grindstone drive device 34 is located.

Also, the grinding liquid feeder 22 is provided with another nozzle 22*a* that travels together with the inner-surface electrode 20, and can supply conductive grinding liquid between the inner-surface grindstone 14 and the inner-surface electrode 20 at a location where the inner-surface electrode 20 comes close to the inner-surface grindstone 14.

A voltage application means 24 is composed of a power source 24*a*, a brush 24*b* that contacts the rotating axes of grindstones 12, 14, and a power line 24*c* that connects brush 24*b* and electrodes 18, 20 electrically to the power source 24*a*, and applies positive and negative voltages to grindstones 12, 14 and electrodes 18, 20, respectively. The power source 24*a* should be a constant-current-type ELID power supply that can provide DC voltage pulses.

According to the method of the present invention using the aforementioned apparatus, end surfaces and oblique surfaces of the outer and inner peripheries of the glass substrate 1 are ground simultaneously by means of the outer-surface grindstone 12 and the inner-surface grindstone 14. In addition, the outer-surface grindstone 12 is dressed electrolytically and sharpened during grinding. Furthermore, during a non-processing period when the glass substrate 1 has completed processing and is being replaced, the inner-surface grindstone 14 is dressed electrolytically to sharpen it.

According to the method and the apparatus of the present invention described above, end surfaces and oblique surfaces of outer and inner peripheries of the glass substrate 1 can be ground simultaneously using the outer-surface grindstone 12 and the inner-surface grindstone 14. In addition, a conductive grinding liquid is supplied during this grinding between the outer-surface grindstone 12 and the outer-surface electrode 18, and the grindstone is in-process dressed (ELID grinding) using the voltage application means 24. Therefore, even when fine grinding particles, for instance, #1200 (grain diameter of about 15 $\mu$m) to #2000 (grain diameter of about 8 $\mu$m) are used, the glass substrate can be processed highly efficiently with high quality and high precision because of the periodic sharpening of the outer-surface grindstone. Moreover, the inner-surface grindstone is dressed electrolytically by the same voltage application means by supplying conductive grinding liquid between the grindstone and the inner-surface electrode 20 during a non-processing period when the glass substrate 1 is replaced (the interval dressing), so even if similar fine grinding particles to those above are used, the inner-surface grindstone can be sharpened continually and can process the workpiece with high precision and high quality while maintaining a high work efficiency.

In addition, because the outer-surface grindstone 12 undergoes in-process dressing during processing and the inner-surface grindstone 14 undergoes interval dressing when processing is stopped, power loads of the voltage application means 24 can be averaged, and the power source can be made more compact than the case in which both grindstones are dressed electrolytically at the same time.

In addition, since outer peripheries of the outer-surface grindstone 12 and the inner-surface grindstone 14 are cylindrical surfaces provided with frustum-like grooves 12*a*, 14*a* respectively that can contact end surfaces and oblique surfaces, the edge portions of the glass substrate can be processed by grinding with high precision and highquality simply by contacting the frustum-like grooves 12*a*, 14*a* with respective edge portions of the glass substrate 1 (outer and inner peripheries).

In this configuration, the plurality of frustum-like grooves 12*a*, 14*a* are arranged with spacings on the same axis of the outer-surface grindstone 12 and the inner-surface grindstone 14, respectively; therefore, the grinding process does not cease, but can be carried out continuously simply by shifting the grooves in the axial direction as soon as the accuracy of shape of the groove no longer satisfies a predetermined value due to wear during processing. This shifting of the grooves permits an extended period of continuous operation.

When frustum-like grooves 12*a*, 14*a* are configured separately for rough and finish processing with intervals on the same axis of the outer-surface grindstone 12 and the inner-surface grindstone 14, the workpiece can first be roughly processed using the frustum-like grooves 12*a*, 14*a* that are used for rough processing and then the workpiece can be shifted axially and the step of finish processing performed using the frustum-like grooves 12*a*, 14*a* of the same grindstone that are used for finish processing; therefore, compared to prior art processing methods where the worn grindstone is replaced with another fresh grindstone, the method of the present invention reduces down time significantly while avoiding deterioration of processing accuracy due to decentering of the rotation axis (also known as the "shifting of rotating center").

Figure 6:
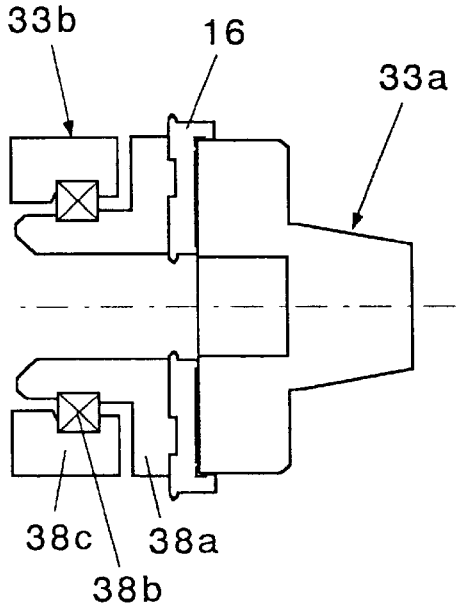
FIG. 6 is an enlarged view of a head portion for discharge truing.

FIG. 6 is an enlarged view of the head part during discharge truing. In FIG. 6, the chamfering apparatus 10 according to the present invention is provided with a vacuum suction head 33*a* and a detachable discharge truing electrode 16 sandwiched between the vacuum suction head 33*a* and a supporting head 33*b*. The outer and inner peripheries of this electrode 16 are identical in shape to the outer and inner peripheries of the glass substrate 1.

In addition, the above-mentioned voltage application means 24 can apply positive and negative voltages to the discharge truing electrode 16 and the grindstones 12, 14, respectively by switching the connection.

According to the method of the present invention, using the aforementioned apparatus, the discharge truing electrode 16 is installed between the vacuum suction head 33*a* and the supporting head 33*b* in place of the glass substrate 1, and the outer-surface grindstone 12 and the inner-surface grindstone 14 are positioned at a grinding location and both grindstones are formed by discharge truing. A conductive mist is also used during this discharge truing, thereby efficient and high-accuracy discharge forming is enabled.

Using this method, even if the shape accuracy of the outer-surface grindstone 12 or the inner-surface grindstone 14 adversely changes because of long-term operation, the deteriorated grindstone can be trued by discharge and formed highly precisely without the need to remove the grindstone from the system; therefore, installation errors caused by removing or reinstalling the grindstone can be avoided. In addition, the power source for electrolytic dressing (the voltage application means) can also be used for discharge truing simply by changing polarity, so the power facility need not be large.

According to the present invention described above, because in-process dressing (ELID grinding) and interval dressing are used jointly, even if grinding particles as fine as #1200 (grain diameter of about 15 $\mu$m) to #2000 (grain diameter of about 8 $\mu$m) are used, grindstones are sharpened as required at any time and can process the workpiece highly accurately and with high quality while maintaining a high processing efficiency. Because the grindstones undergo in-process dressing during processing and interval dressing when processing is stopped, work loads of the voltage application means 24 can also be averaged and the power facility can be made more compact. Furthermore, since a plurality of frustum-like grooves 12*a*, 14*a* are arranged at intervals on the coaxis of the grindstones 12, 14 respectively, any working groove for which the accuracy of shape can no longer satisfy a predetermined accuracy due to processing wear can be shifted axially, and the grooves can be used sequentially; therefore, the process of grinding need not be interrupted, but can be carried out continuously, so continuous operating time can be greatly extended. In addition, frustum-like grooves for rough and finish processing respectively can be provided on the same axis, thus after a rough grinding process is completed, the grindstone can be shifted axially and can finish grinding the workpiece during a finish grinding process, thereby down-time is reduced dramatically and the degradation of processing accuracy caused by deviation of the center can be avoided. Alternatively, a discharge truing electrode 16 can be installed in place of the glass substrate 1 and can true both grindstones by discharge, so that any installation error due to removing or reinstalling grindstones can be avoided. Instead, high-accuracy forming can be maintained by discharge truing with the grindstones in place.

Accordingly, the method and the apparatus for chamfering a glass substrate disclosed by the description of the present invention provides superior results over the prior art methods including the benefits of the processing of edge portions of a glass substrate for a hard disk with precision, improved efficiency, and with high quality to such an extent that the need for a subsequent process, such as buff-polishing, can be reduced or even eliminated.

Although the present invention has been described referring to several preferred embodiments, the scope of rights encompassed by the present invention should not be interpreted to be limited only to these embodiments. To the contrary, the scope of rights encompassed by the present invention shall include all improvements, corrections, and equivalent entities covered by the scope of the attached claims.

What is claimed is:

1. A method of chamfering surfaces of a doughnut-shaped glass substrate having a circular center hole, the method of chamfering a glass substrate comprising:

providing a doughnut-shaped glass substrate having an end surface, a circular center hole, and an oblique surface of each of an outer periphery and an inner periphery, respectively;

positioning the glass substrate for processing;

processing the glass substrate by grinding, wherein a metal-bonded outer-surface grindstone processes the end surface and the oblique surface of the outer periphery and a metal-bonded inner-surface grindstone simultaneously processes the end surface and the oblique surface of the inner periphery;

electrolytically dressing and sharpening the outer-surface grindstone during a processing period;

electrolytically dressing and sharpening the inner-surface grindstone during a non-processing period; and replacing the glass substrate during the non-processing period with another doughnut-shaped glass substrate having an end surface, a circular center hole, and an oblique surface of each of an outer periphery and an inner periphery, respectively.

2. A method of chamfering a glass substrate according to claim 1, further comprising the steps of:

providing a truing electrode for truing said grindstones;

positioning said grindstones at a respective grinding location;

charging said electrode with a negative voltage while charging said grindstones with a positive voltage by switching connection to a voltage application means; and forming said grindstones by discharge truing.

3. A chamfering apparatus for processing surfaces of a doughnut-shaped glass substrate having a circular center hole, the glass substrate chamfering apparatus comprising:

a metal-bonded outer-surface grindstone for simultaneously processing an end surface and an oblique surface of an outer periphery of a glass substrate;

a metal-bonded inner-surface grindstone for simultaneously processing an end surface and an oblique surface of an inner periphery of a glass substrate;

an outer-surface electrode for electrolytically dressing the outer-surface grindstone during a processing period;

an inner-surface electrode for electrolytically dressing the inner-surface grindstone during a non-processing period;

a grinding liquid feeder for supplying a conductive grinding liquid between the outer-surface grindstone and the outer-surface electrode, and between the inner-surface grindstone and the inner-surface electrode; and voltage application means for applying an electrolyzing voltage across the outer-surface grindstone and the outer-surface electrode, and across the inner-surface grindstone and the inner-surface electrode, wherein the outer-surface grindstone is electrolytically dressed while a glass substrate is ground during the processing period and the inner-surface grindstone is electrolytically dressed when a glass substrate is not processed during the non-processing period.

4. A glass substrate chamfering apparatus according to claim 3, wherein said metal-bonded outer-surface grindstone and said metal-bonded inner-surface grindstone each have an outer periphery that is a cylindrical surface comprising frustum grooves for contacting end surfaces and oblique surfaces of said glass substrate.

5. A glass substrate chamfering apparatus according to claim 4, wherein said frustum grooves of said metal-bonded outer-surface grindstone or said metal-bonded inner-surface grindstone comprise a plurality of frustum grooves disposed and spaced along one axis.

6. A glass substrate chamfering apparatus according to claim 4, wherein said frustum grooves of said metal-bonded outer-surface grindstone and said metal-bonded inner-surface grindstone comprise a plurality of frustum grooves disposed and spaced along one axis.

7. A glass substrate chamfering apparatus according to claim 4, wherein said frustum grooves of said metal-bonded outer-surface grindstone and said metal-bonded inner-surface grindstone comprise a plurality of rough-processing and finish-processing frustum grooves disposed and spaced along one axis.

8. A glass substrate chamfering apparatus according to claim 4, wherein said frustum grooves of said metal-bonded outer-surface grindstone or said metal-bonded inner-surface grindstone comprise a plurality of rough-processing and finish-processing frustum grooves disposed and spaced along one axis.

9. A glass substrate chamfering apparatus according to 4, further comprising:

a substrate drive device for driving a glass substrate to rotate around an axial center thereof;

an outer-surface grindstone drive device for driving said outer-surface grindstone around an axial center thereof; and an inner-surface grindstone drive device for driving said inner-surface grindstone around an axial center thereof, wherein said substrate drive device, said outer-surface grindstone drive device and said inner-surface grindstone drive device are configured to be movable between a glass substrate processing location and a non-processing location so that said outer-surface grindstone and said inner-surface grindstone are removable from a replaceable glass substrate when said drive devices are at said non-processing location.

10. A glass substrate chamfering apparatus according to 4, further comprising:

a substrate drive device for driving a glass substrate to rotate around an axial center thereof;

an outer-surface grindstone drive device for driving said outer-surface grindstone around an axial center thereof; and an inner-surface grindstone drive device for driving said inner-surface grindstone around an axial center thereof, wherein said substrate drive device, said outer-surface grindstone drive device or said inner-surface grindstone drive device respectively is configured to be movable between a glass substrate processing location and a non-processing location so that said outer-surface grindstone and said inner-surface grindstone are removable from a replaceable glass substrate when said movable drive device is at said non-processing location.

11. A glass substrate chamfering apparatus according to claim 9, wherein said substrate drive device comprises:

a vacuum suction head for applying suction to a glass substrate; and a supporting head for holding a glass substrate, wherein a glass substrate can be simultaneously held to said vacuum suction head by said supporting head while said vacuum suction head applies suction.

12. A glass substrate chamfering apparatus according to claim 10, wherein said substrate drive device comprises:

a vacuum suction head for applying suction to a glass substrate; and a supporting head for holding a glass substrate, wherein a glass substrate can be simultaneously held to said vacuum suction head by said supporting head while said vacuum suction head applies suction.

13. A glass substrate chamfering apparatus according to claim 11, further comprising:

a discharge truing electrode sandwiched and held between said vacuum suction head and said supporting head, said truing electrode comprising an outer periphery and an inner periphery respectively matching an outer periphery and an inner periphery of a glass substrate, wherein said truing electrode is detachable.

14. A glass substrate chamfering apparatus according to claim 12, further comprising:

a discharge truing electrode sandwiched and held between said vacuum suction head and said supporting head, said truing electrode comprising an outer periphery and an inner periphery respectively matching an outer periphery and an inner periphery of a glass substrate, wherein said truing electrode is detachable.

* * * * *